US005880436A

United States Patent [19]

Keogh

[11] Patent Number: 5,880,436

[45] Date of Patent: Mar. 9, 1999

[54] FAIL-SAFE CONVECTION OVEN ASSEMBLY

[75] Inventor: Alan Keogh, Oakville, Canada

[73] Assignee: Garland Commercial Industries, Inc., Freeland, Pa.

[21] Appl. No.: 938,255

[22] Filed: Sep. 26, 1997

[51] Int. Cl.[6] ..... F27D 7/04; F27D 21/00

[52] U.S. Cl. ..... 219/400; 219/668; 219/414; 219/507; 219/723; 126/197; 34/534; 99/337

[58] Field of Search ..... 219/400, 412–414, 219/507, 508, 509, 668, 723; 99/325, 331, 337; 34/534, 218, 219; 126/21 R, 21 A, 197

[56] References Cited

U.S. PATENT DOCUMENTS

| | | | |
|---|---|---|---|
| 3,861,866 | 1/1975 | Saario . | |
| 3,887,266 | 6/1975 | Saario . | |
| 3,936,659 | 2/1976 | Mainord . | |
| 4,413,173 | 11/1983 | Grove et al. | 219/412 |
| 4,491,065 | 1/1985 | Poulson . | |
| 4,515,143 | 5/1985 | Jabas . | |
| 5,339,726 | 8/1994 | Poulson . | |
| 5,422,458 | 6/1995 | Simmel | 99/337 |
| 5,619,983 | 4/1997 | Smith | 99/331 |
| 5,639,497 | 6/1997 | Bedford et al. | 99/331 |
| 5,780,815 | 7/1998 | Mestnik et al. | 219/400 |

*Primary Examiner*—Teresa Walberg
*Assistant Examiner*—J. Pelham
*Attorney, Agent, or Firm*—Ohlandt, Greeley, Ruggiero & Perle

[57] ABSTRACT

An oven assembly having a housing enclosing a cooking compartment and a blower compartment, and having a blower for circulating air within the cooking compartment, a door mounted to the housing, and a failsafe switch that is capable of deactivating the blower when the door is opened beyond a set point in the range between at least about 10% to 50%.

10 Claims, 2 Drawing Sheets

FAIL-SAFE CONVECTION OVEN ASSEMBLY

BACKGROUND OF THE INVENTION

Convection ovens are widely used in restaurants for cooking a variety of food products. Many fast food restaurant menu items require rapid cooking, and such restaurants have found it advantageous to cook those items in a convection oven to expedite the cooking time. In a convection oven, it is necessary for an internal blower mechanism to be engaged during operation, to force the heated air through the convection oven chamber. This blower mechanism increases the effectiveness of the oven, but presents a safety hazard. Specifically, the fan element of the blower mechanism is accessible through the oven door. The fan is seated behind an air panel, which panel can be removed. This allows the fan element to be cleaned after the oven has been used. In existing ovens, a risk exists that the blower mechanism could be activated (possibly by the activation of the cooldown cycle) while an operator is cleaning the fan element.

Ovens are known in the art in which the fan element is powered off when the oven door is opened. However, such ovens are unsuitable for use because the oven only cools efficiently when the oven door is ajar and the blower is running. By disabling the blower when the oven door is opened, even slightly, effective cooling is curtailed. Accordingly, a need exists for an oven having a safety mechanism that allows the door to be opened partially, to permit the oven to cool, without deactivating the blower. However, once the oven door is open sufficiently to allow an operator to access the blower mechanism, the blower is deactivated. The present invention provides such a failsafe convection oven assembly. The present invention also provides many additional advantages which shall become apparent as described below.

SUMMARY OF THE INVENTION

The present invention provides an oven assembly having a housing enclosing a cooking compartment and a blower compartment, a door mounted to the housing, and a switch activated when the door reaches a set point of more than about 10% open, but not wide enough for the blower compartment to be easily accessible by an operator. The blower compartment contains a blower, and the switch deactivates the blower when the switch is activated. The set point is preferably at least about 40%. The failsafe switch is preferably a pressure-sensitive switch or a magnetic switch, and it can be a double action switch, for example, to control a light in the oven, and possibly also a heating element in the oven. The cooking compartment and the blower compartment are separated by an air panel, and the air panel is a removable wire mesh screen. A stop can be incorporated to keep the door open to a desired degree less than the set point, to permit efficient cooling without activating the failsafe switch.

Other and further objects, advantages and features of the present invention will be understood by reference to the following specification in conjunction with the annexed drawings, wherein like parts have been given like numbers.

DESCRIPTION OF THE PREFERRED EMBODIMENTS

Figure 1:
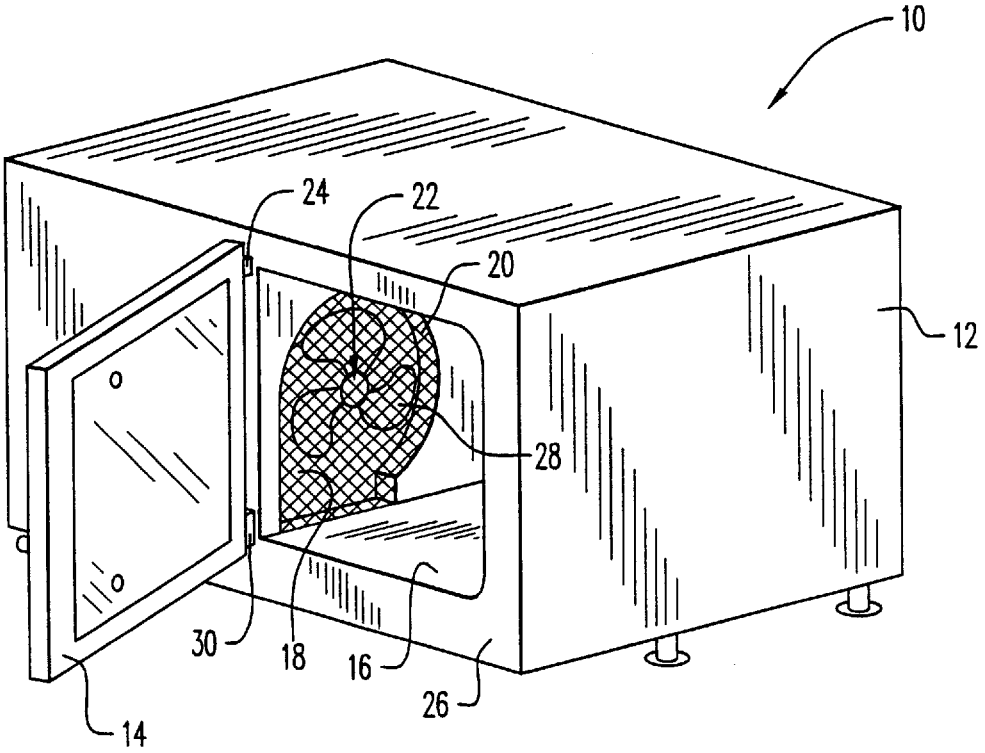
FIG. 1 is a perspective view of an oven assembly according to the present invention.
Figure 2:
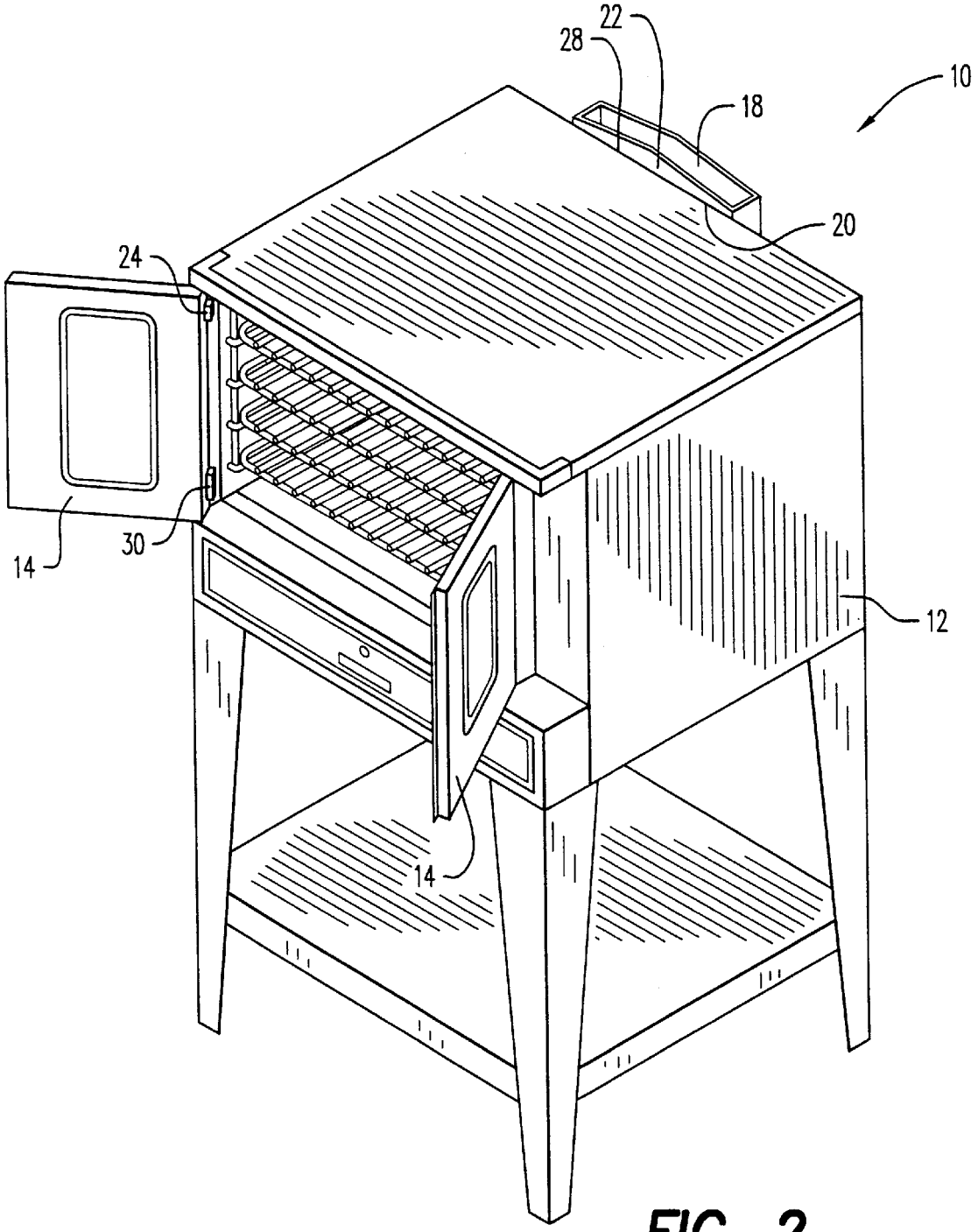
FIG. 2 is a perspective view of an alternate preferred embodiment oven assembly according to the present invention.

Two preferred configurations of the failsafe oven assembly of the present invention are depicted in the appended drawings, specifically, FIGS. 1 and 2. The oven assemblies of these embodiments are generally referred to by reference numeral 10. Oven assembly 10 includes housing 12, door or doors 14, cooking compartment 16 and blower compartment 18. Cooking compartment 16 and blower compartment 18 are subdivided by air panel 20. Behind air panel 20, within blower compartment 18, is seated blower 22. According to the present invention, door 14 (or doors 14) is provided with a failsafe switch 24. Switch 24 permits door 14 to be opened a preset amount for cooling, without deactivating blower 22. However, once door 14 is opened beyond the preset amount, switch 24 deactivates blower 22.

Switch 24 can be a single action or double action switch. If it is a double action switch, switch 24 can also control, for example, an internal light or heater (not shown).

Switch 24 can operate based on pressure, magnetic field or other similar bases, as are known in the art.

Switch 24 can be set to deactivate blower 22 at any appropriate setting. In the preferred embodiment, it is preferred that switch 24 be activated when door 14 is opened beyond a set point in the range between about 10% to about 50%. It is more preferred that switch 24 be activated when door 14 is opened beyond a set point of at least about 40%. For purposes of the preferred embodiment of FIG. 1, for example, door 14 is closed when door 14 is displaced 0° from the plane of front panel 26 of housing 12. When door 14 is displaced through 100° from the plane of front panel 26, it is fully open, and its motion is arrested by a stop mechanism 30. Thus, door 14 is 10% open when it has traveled 10° from front panel 26; it is 40% open when it has traveled 40° from front panel 26; and it is 50% open when it has traveled 50° from front panel 26. These percentage measurements will vary based on the range of angular displacement through which door 14 can travel.

Similarly, in the embodiment depicted in FIG. 2, switches 24 can be activated when one of the two doors 14 is opened beyond a set point, or when both doors 14 are opened beyond the same set point or a different set point. Preferably, both parameters are incorporated into oven assembly 10.

It is most preferred that switch 24 be activated when door 14 reaches a point at which an operator can have clear access to air panel 20, sufficient to permit the operator to remove air panel 20 and clean blower 22. This can best be determined with reference to the specific dimensions of door 14, cooking compartment 16 and blower compartment 18. Blower 22 preferably includes multiple fan blades 28, which when rotating at high speed can present a serious safety hazard to anyone coming in contact with blades 28.

It is preferable that the oven assemblies of the present invention include a stop 30 for holding door 14 at the position desired, to keep door 14 ajar slightly if efficient cooling is desired, without activating switch 24.

While the preferred use of the oven assemblies of the present invention is in a convection oven, any oven containing a rotating fan mechanism or other hazardous moving or heated part can be adapted to use the teachings of the present invention. In addition, it is not necessary that the blower compartment and the cooking compartment be physically separate or blocked off from one another; in fact, the oven assemblies of the present invention would be particularly useful where a blower is not compartmentalized or otherwise protected.

The invention having been thus described with particular reference to the preferred forms thereof, it will be obvious that various changes and modifications may be made therein without departing from the spirit and scope of the invention as defined in the appended claims.

What is claimed is:

1. An oven assembly comprising:

a housing enclosing a cooking compartment and a blower compartment, and having a means for circulating air within said cooking compartment;

a door mounted to said housing; and a failsafe switch that is capable of deactivating said means for circulating air when said door is opened beyond a set point in the range greater than about 10%, but not open enough for said blower compartment to be accessible by an operator.

2. The oven assembly of claim 1, wherein said set point is at least about 40%.

3. The oven assembly of claim 1, wherein said failsafe switch is selected from the group consisting of pressure-sensitive switches and magnetic switches.

4. The oven assembly of claim 1, wherein said failsafe switch is a double action switch.

5. The oven assembly of claim 4, wherein said failsafe switch also controls a light in said oven.

6. The oven assembly of claim 4, wherein said failsafe switch also controls a heating element in said oven.

7. The oven assembly of claim 1, wherein said cooking compartment and said blower compartment are separated by an air panel.

8. The oven assembly of claim 7, wherein said air panel is a removable wire mesh screen.

9. The oven assembly of claim 1, further comprising stop means to keep said door open to a desired degree less than said set point, to permit efficient cooling without activating said failsafe switch.

10. The oven assembly of claim 1, comprising two doors and two switches, wherein said two switches are capable of deactivating said means for circulating air when one or both of said two doors is opened beyond a set point in the range greater than about 10%, but not open enough for said blower compartment to be accessible by an operator.

* * * * *